US007732388B2

(12) United States Patent
Peltier

(10) Patent No.: US 7,732,388 B2
(45) Date of Patent: Jun. 8, 2010

(54) PHOSPHOLIPID LUBRICANT FOR COATING MOVING WEBS

(75) Inventor: Ray Peltier, Franconia, NH (US)

(73) Assignee: Bercen Incorporated, Cranston, RI (US)

( * ) Notice: Subject to any disclaimer, the term of this patent is extended or adjusted under 35 U.S.C. 154(b) by 965 days.

(21) Appl. No.: 11/329,710

(22) Filed: Jan. 10, 2006

(65) Prior Publication Data

US 2006/0154832 A1 Jul. 13, 2006

(51) Int. Cl.
*C10M 137/04* (2006.01)

(52) U.S. Cl. ..... 508/428; 162/135; 162/136; 162/179; 106/243; 427/209

(58) Field of Classification Search ..... 508/428
See application file for complete search history.

(56) References Cited

U.S. PATENT DOCUMENTS 4,766,015 A * 8/1988 Nikoloff et al. ..... 427/326
5,328,567 A 7/1994 Kinsley, Jr.
5,658,374 A 8/1997 Glover
5,858,933 A 1/1999 Nikoloff
6,007,627 A * 12/1999 Barnholtz ..... 118/411
6,191,079 B1 * 2/2001 Klima et al. ..... 508/431

FOREIGN PATENT DOCUMENTS

WO WO-94/05721 3/1994
WO WO-01/51706 A1 7/2001
WO WO-01/81679 A1 11/2001

OTHER PUBLICATIONS

Hawley's Condensed Chemical Dictionary, 14th Edition Copyright © 2002 by John Wiley & Sons, Inc.*

* cited by examiner

*Primary Examiner*—Glenn A Caldarola
*Assistant Examiner*—Taiwo Oladapo
(74) *Attorney, Agent, or Firm*—Caesar, Rivise, Bernstein, Cohen & Pokotilow, Ltd.

(57) ABSTRACT

Lubricant formulations comprising a phospholipids such as lecithins and a low hydrophobic lipophilic balance (HLB) surfactant provide improved rheological properties for coating a rapidly moving web, such as a paper web. The low hydrophobic lipophilic balance (HLB) surfactant is preferably an alcohol ethoxylate having an HLB value of between 7 and 10 or more preferably between 7.5 and 9.5. The lubricant formulations of the invention are preferably applied to the paper web as part of a coating mixture. The lubricant is well-suited for short-dwell coating methods.

27 Claims, 3 Drawing Sheets

FIG. 1
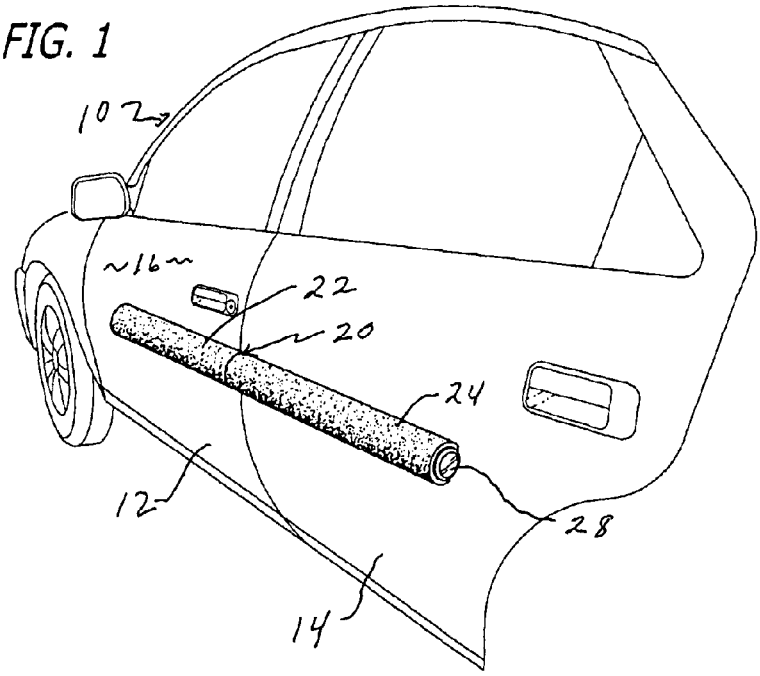
FIG. 2
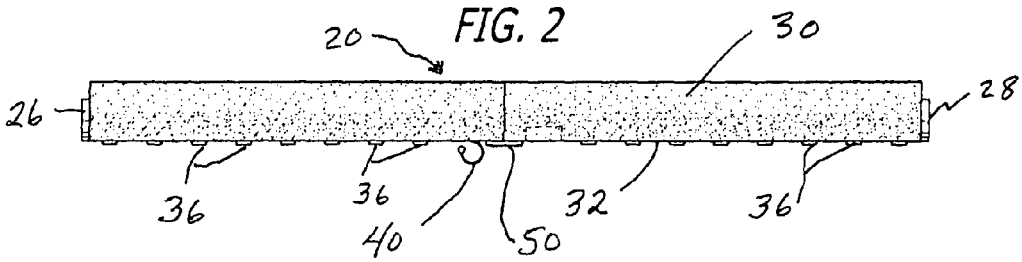
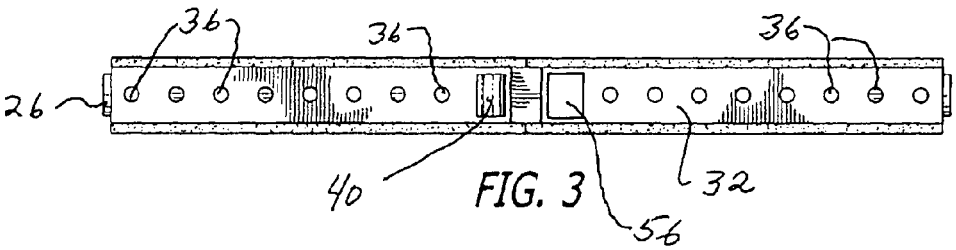
FIG. 3

FIG. 4
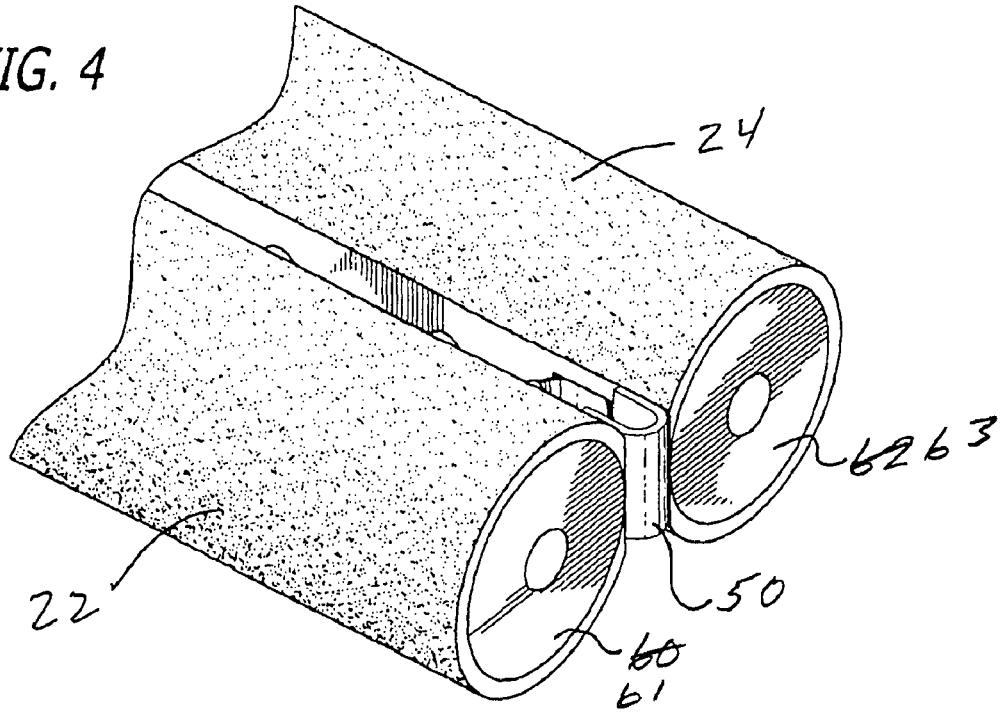
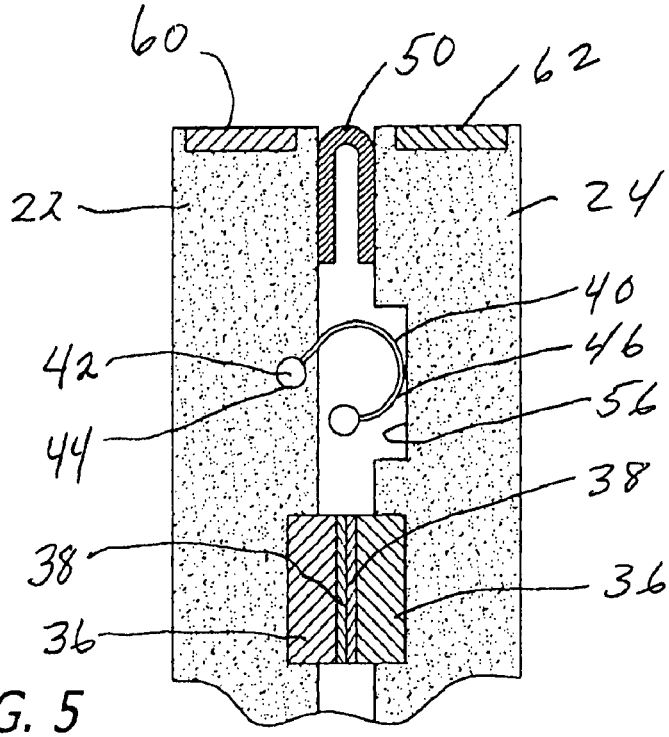
FIG. 5

PHOSPHOLIPID LUBRICANT FOR COATING MOVING WEBS

BACKGROUND

1. Field of the Invention

This invention relates to lubricant additives for coating moving paper and paper board webs. More particularly, the invention provides lecithin based lubricant additive formulations having an alcohol ethoxylate surfactant component having a hydrophilic lipophilic balance (HLB) parameter of less than 10.

2. Background of the Invention

Paper and paper board web material is frequently coated to improve properties such as appearance and printability. The coating process involves applying a coating mixture to the paper as it moves at high speed through a coating apparatus. These coatings are typically composed of: (1) pigments, such as Kaolin clay, titanium dioxide, calcium carbonate or silicates; (2) adhesive binders, such as starches, proteins, styrene butadiene latex, or polyvinyl acetates; and (3) additives, which improve or modify specific properties and characteristics of the coating mixture.

A number of chemical phenomena and physical forces (particularly shear forces) can have a detrimental effect, e.g., destroying the integrity and uniformity of both the coating mixture and the coating as it is applied to the paper sheet. When this occurs, costly problems develop both in the application of the coating and in the finish and quality of the coated paper. These problems are widely known to manufacturers of coated papers.

These problems are greatly magnified as the speed of the web moving through the coating apparatus is increased, causing increased shear forces on the coating mixture being applied. Increased speed causes problems in viscosity control, calcification, streaking, whiskering, and generally poor "runnability" (performance) of the coating. These problems ultimately result in a poor quality coated sheet. Uniformity of the coating mix at these high shear levels is critical.

Typically, lubricant additives, such as calcium stearate dispersions or polyethylene dispersions, have been used as an additive to the coating mixture to improve the performance and uniformity of the coating and the overall integrity of the coating mixture. The main function of a lubricant additive in a coating mixture is to increase the lubricity of the coating. However, many other effects of lubricants are known to the art of coating paper. For example, such characteristics as rheological properties, plasticity, smoothness, coating gloss, anti-dusting and improved printing qualities, can be affected by the use of coating lubricants.

U.S. Pat. No. 4,766,015 recites lubricant formulations having a mixture of lecithin, a fatty acid, an emulsifier and a surfactant. The '015 patent recites formulations in which the surfactant was selected from water soluble nonylphenol ethoxylates (NPEs) having an HLB of greater than 13 or water soluble alcohol ethoxylates having an HLB value of between 11 and 13.

International patent publication WO 01/51706 recite various lubricant formulations based on lecithin in combination with at least one fatty acid and a surfactant selected from anionic or high HLB nonyl phenol ethoxylates (NPEs).

U.S. Pat. No. 5,858,933 recites lubricant formulations having a chemically modified lecithin as a lubricant. Although '933 patent asserts that the chemically modified lecithin, e.g., hydroxylated lecithin, eliminates the need for a fatty acid additive, the increased cost associated with chemical modification results in an economically unfeasible lubricant for paper manufacture.

Thus, it would be desirable to provide new less expensive lecithin based lubricant formulations which provide improved processing during the paper making process and improved finished paper properties.

SUMMARY OF THE INVENTION

We have discovered that lubricant formulations comprising phospholipid compositions such as "lecithins" and a surfactant having a hydrophilic-lipophilic balance (HLB) value of less than 10 as described below significantly improve the rheological properties of aqueous coatings for rapidly moving webs, such as paper webs, generally enabling high web speeds and high levels of solid loading in the coating mixture.

One aspect of the invention features a method of applying an aqueous-based coating to a rapidly moving paper or paper board web in which a lubricant formulation comprising the phospholipid and low HLB surfactant is included in the coating mixture to be applied to the web. By aqueous-based, we mean the vehicle for the coating mixture is water or water and water-miscible fluids.

Preferably, the phospholipid is a "lecithin" which comprises phosphatidylcholine, phosphatidylethanolamine, phosphatidylinositol, phosphatidic acid, or mixtures thereof. Also preferably, a fatty acid selected from linoleic, linolenic, oleic, palmitic, stearic, and coconut fatty acids, is included in the coating mixture. It is also preferable to include fatty acid esters into the composition. The coating mixture to be applied to the web further comprises a pigment, particularly an inorganic pigment such as clay or calcium carbonate. The coating mixture is applied to paper or paperboard webs traveling at least 500 feet/min (and most preferably much faster, e.g. over 1500 feet/min).

Also preferably, a "short-dwell" method is used; i.e., a method in which the coating mixture is applied to the web under pressure while a device such as a doctor blade controls coating thickness.

The preferred coating mixture has a solids content by weight of between 50 and 75%, and the solids portion comprises (by weight): 10-90% binder, 10-90% pigment, and 0.2-5% phospholipid lubricant.

The resulting coating mixture enables a high solids content and can be used in high-speed paper coating equipment, e.g. "short dwell" equipment. The preferred coating mixture comprises clay pigment (e.g., Kaolin clay), but other coatings also can be used, such as coatings comprising calcium carbonate, titanium dioxide, silica, zinc oxide, aluminum powder, synthetic polymers, talc, and diatomaceous earth.

A second aspect of the invention features a lubricant additive mixture adapted for combination with an aqueous-based paper or paperboard coating mixture, comprising a phospholipid, a fatty acid, (particularly one of the above described acids), a fatty acid ester and a surfactant having an HLB of less than 10, or more preferably an HLB of between about 7 and about 10. Preferred lubricant additive mixtures are those described above.

Certain preferred lubricant formulations comprise between about 65-75% of a phospholipid (or more preferably between about 65-75% of lecithin), about 5-20% of a fatty acid, about 5-20% of a fatty acid ester, and about 2-15% of a surfactant having an HLB value of less than about 10. The surfactant preferably has an HLB value of between 7 and 10 and is selected from aliphatic alcohol ethoxylates having between about 2 and about 5 equivalents of ethylene oxide.

A third aspect of the invention features an aqueous paper or paperboard coating mixture comprising clay (e.g., Kaolin) and a lubricant formulation as described herein, the mixture preferably being a slurry adapted for application to a rapidly moving web. The coating mixture is preferably the mixture described above with regard to the first aspect of the invention.

The lubricant additive mixtures of the invention offer superior rheological properties, paper properties and machine operating parameters, including for example, lower high shear viscosity resulting in lower blade pressures and increased machine speeds, increased water retention, improved brightness, improved gloss and improved dry pick strength.

The invention enables desirable rheological properties at high solid loading in the slurry, thus reducing the energy consumed to dry the liquid from the coated product. In addition, the invention maintains the smoothness and integrity of high-solid coatings, reducing unevenness or calcification. Specifically, the invention greatly improves the rheological properties and runnability of the wet coating at high speeds and in shear stress systems. In addition, this invention improves the characteristics of the dried coated paper.

This invention allows the use of coating mixtures in excess of 50% solids by weight. The lubricant can be supplied at 100% active ingredient level. This feature allows the coating formulator to prepare coating mixtures at desirable high solids levels and reduces the amount of water present in the mixture which must be subsequently dried after application.

This invention improves the runnability of the coating mixture in high speed coaters and good results have been obtained on many types of coating equipment. The coating additive contributes to the production of a high quality, uniformly coated web which possesses excellent finish and printing characteristics. Finally, the lubricant is adaptable to high speed technology and generally compatible with coating mixture components.

Other features and advantages of the invention will be apparent from the following description of the preferred embodiments.

BRIEF DESCRIPTION OF THE DRAWINGS

We first briefly describe the drawings of the preferred embodiment of the invention.

DETAILED DESCRIPTION OF THE INVENTION AND PREFERRED EMBODIMENTS

Methods of Coating

Figure 6:
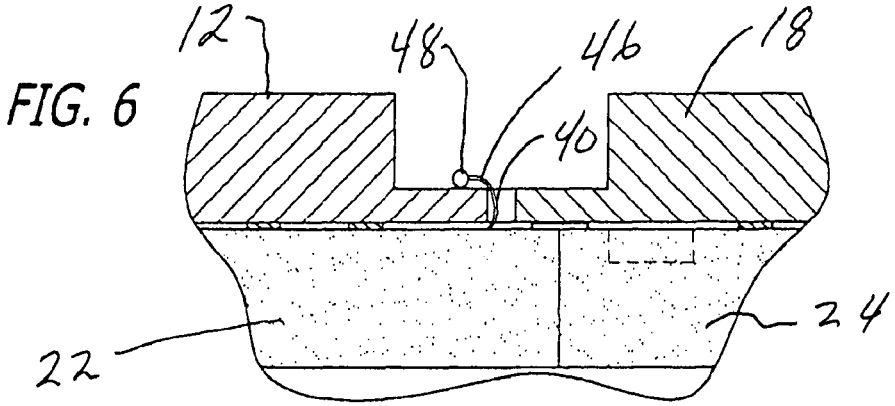
FIG. 6 is a bar graph of IGT Dry Pick for paper made using the lubricant formulations of Example 1 (identified as "New"), Example 2 of U.S. Pat. No. 4,766,015 (identified as "'015"), Example 2 of International patent publication WO 01/51706 (identified as "WO '706"), and Example 1 of U.S. Pat. No. 5,858,933 (identified as "'933")
Figure 7:
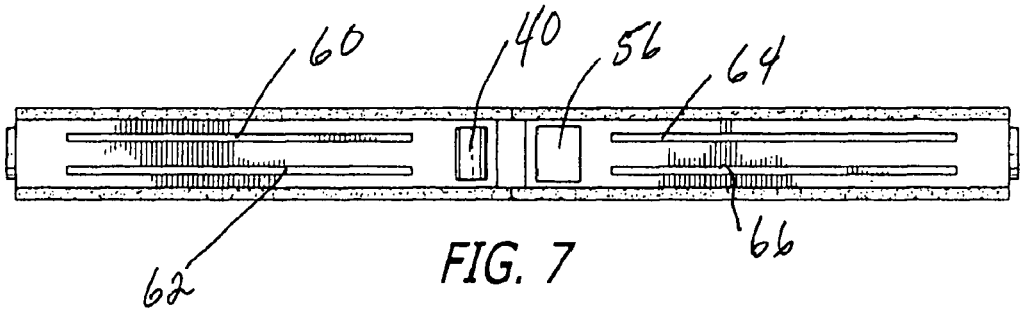
FIG. 7 is a bar graph of Brightness for paper made using the lubricant formulations of Example 1 (identified as "New"), Example 2 of U.S. Pat. No. 4,766,015 (identified as "'015"), Example 2 of International patent publication WO 01/51706 (identified as "WO '706"), and Example 1 of U.S. Pat. No. 5,858,933 (identified as "'933").
Figure 8:
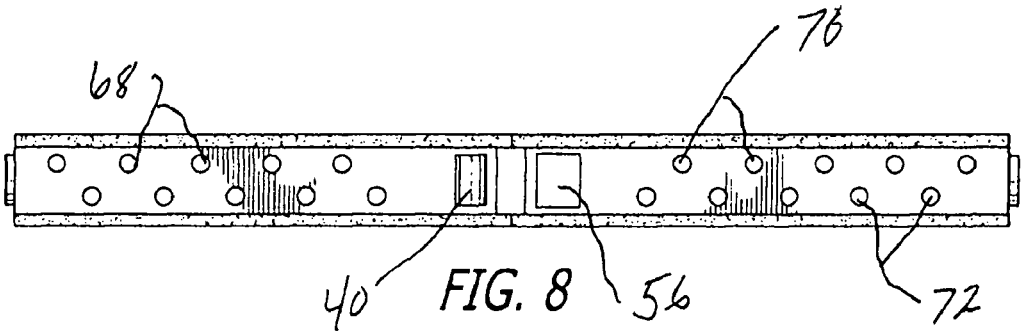
FIG. 8 is a bar graph of Gloss for paper made using the lubricant formulations of Example 1 (identified as "New"), Example 2 of U.S. Pat. No. 4,766,015 (identified as "'015"), Example 2 of International patent publication WO 01/51706 (identified as "WO '706"), and Example 1 of U.S. Pat. No. 5,858,933 (identified as "'933").
Figure 1:
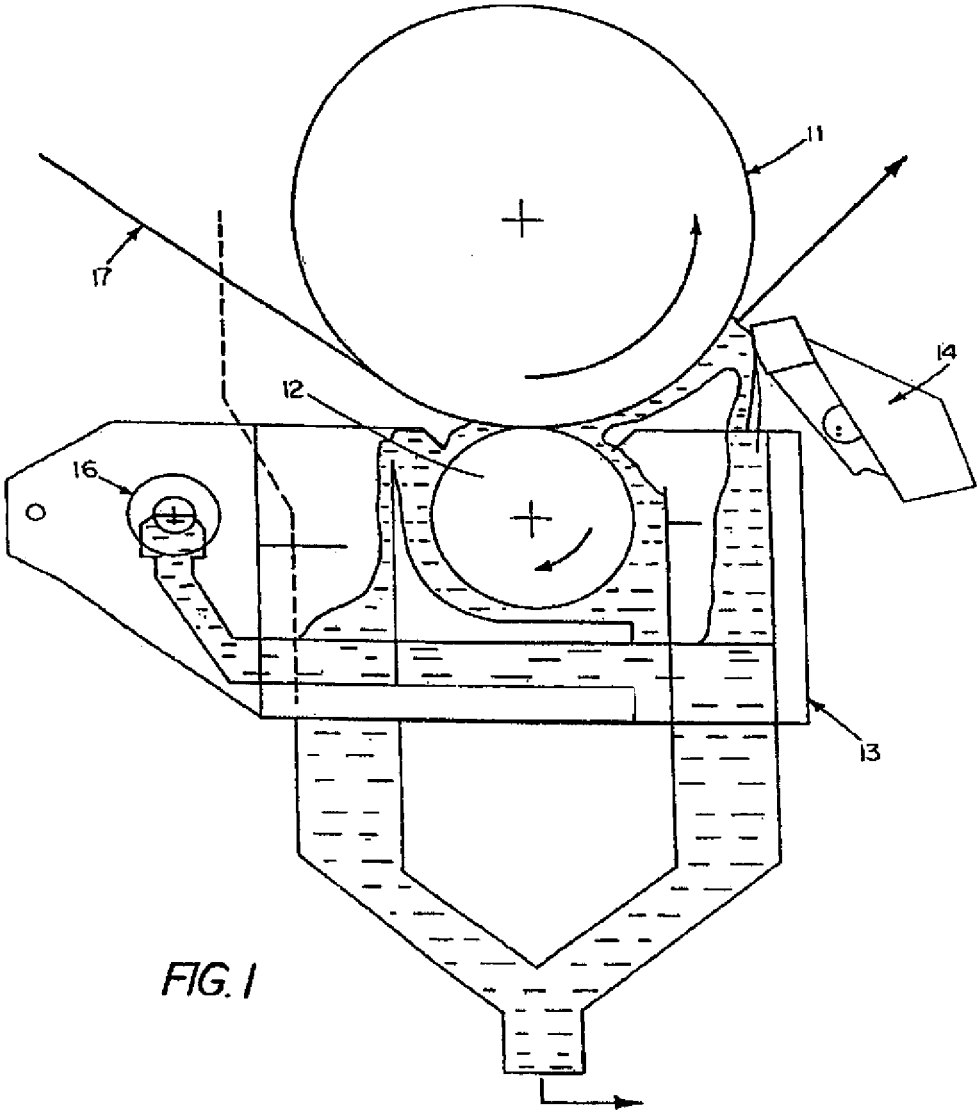
FIG. 1 is a highly diagrammatic representation of apparatus for coating a paper web according to one embodiment of the invention.

FIG. 1 depicts one type of apparatus for coating a paper web, known as a flooded nip coater. Such coaters are utilized for the application of a coating mixture to a moving paper web that travels at high speed through the coater. The basic components of coater 10 are as follows. The paper web 17 moves over a backing roll 11 in the direction indicated on the diagram.

The application roll 12 runs in a pan or reservoir 13 of coating mixture. This mixture has been prepared and the phospholipid lubricant has been added to it during its preparation. The coating is stored in a supply tank and pumped to a header pipe 16. The applicator roll 12 applies a layer of coating to the paper web as it travels through the nip formed by the applicator and backing rolls. Excess coating is removed by a knife blade 14. This knife is positioned in such a way that a uniform layer of coating of appropriate thickness is coated on the web. The design and operation of this type of coater is well known to the paper coating industry.

Figure 2:
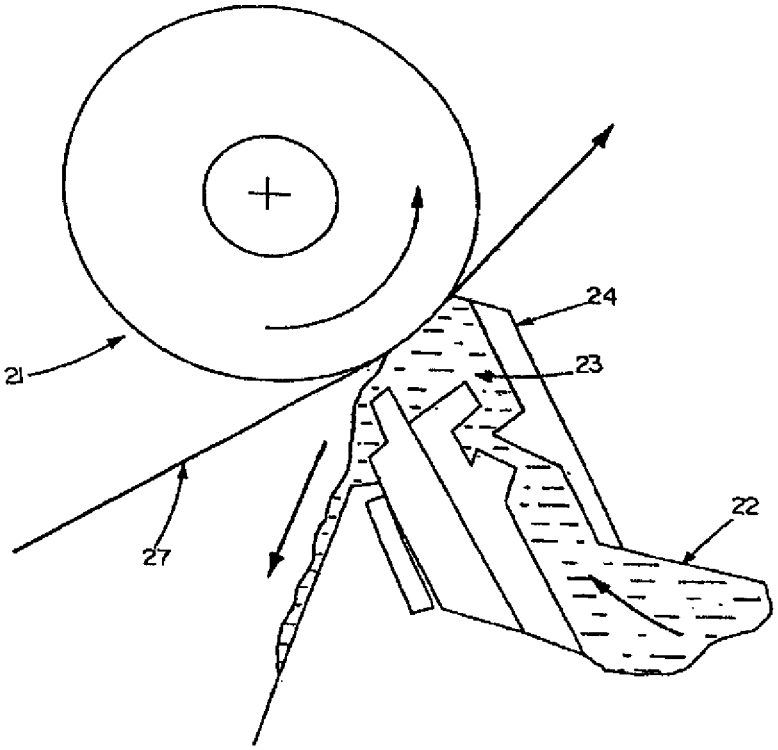
FIG. 2 is a highly diagrammatic representation of apparatus for coating a paper web according to an alternate embodiment of the invention.
Figure 3:
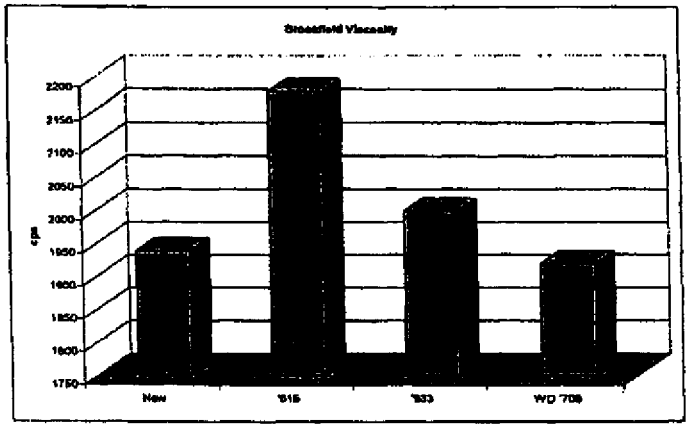
FIG. 3 is a bar graph of Brookfield Viscosity for the lubricant formulation of Example 1 (identified as "New"), Example 2 of U.S. Pat. No. 4,766,015 (identified as "'015"), Example 2 of International patent publication WO 01/51706 (identified as "WO '706"), and Example 1 of U.S. Pat. No. 5,858,933 (identified as "'933")
Figure 4:
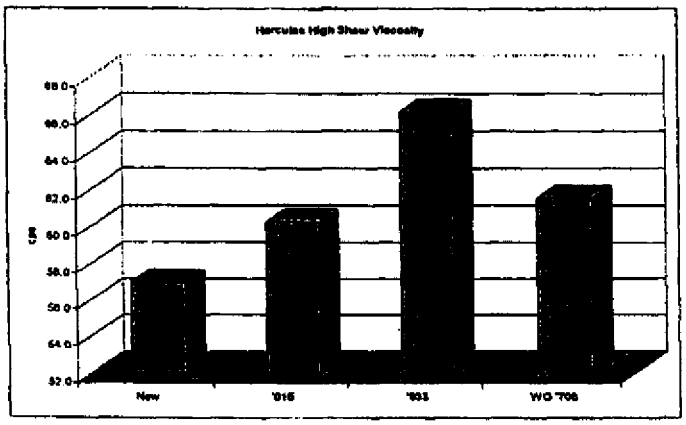
FIG. 4 is a bar graph of Hercules High Shear Viscosity for the lubricant formulation of Example 1 (identified as "New"), Example 2 of U.S. Pat. No. 4,766,015 (identified as "'015"), Example 2 of International patent publication WO 01/51706 (identified as "WO '706"), and Example 1 of U.S. Pat. No. 5,858,933 (identified as "'933")
Figure 5:
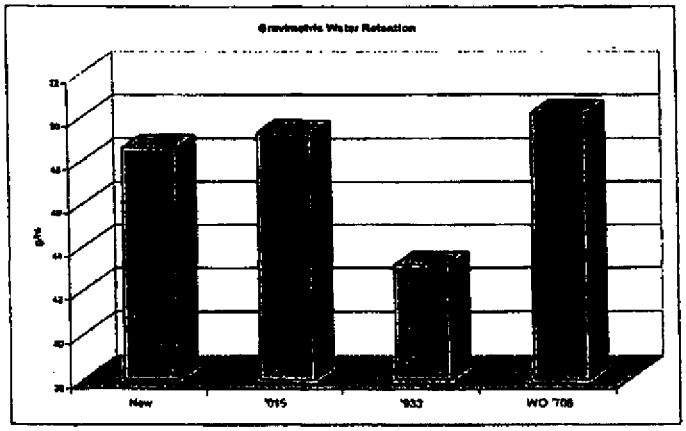
FIG. 5 is a bar graph of Gravimetric Water Retention for the lubricant formulation of Example 1 (identified as "New"), Example 2 of U.S. Pat. No. 4,766,015 (identified as "'015"), Example 2 of International patent publication WO 01/51706 (identified as "WO '706"), and Example 1 of U.S. Pat. No. 5,858,933 (identified as "'933")
Figure 6:
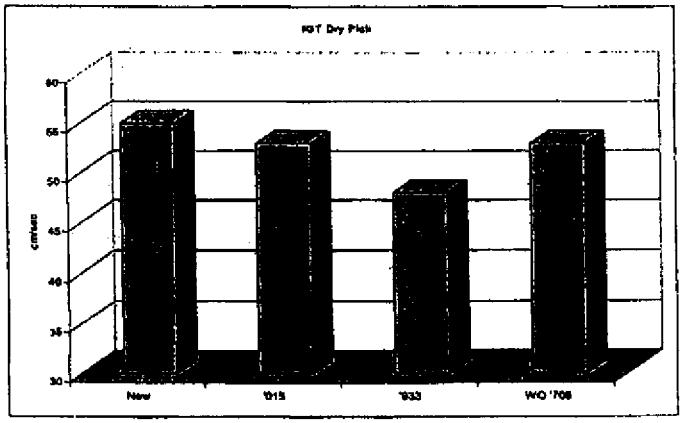
Figure 7:
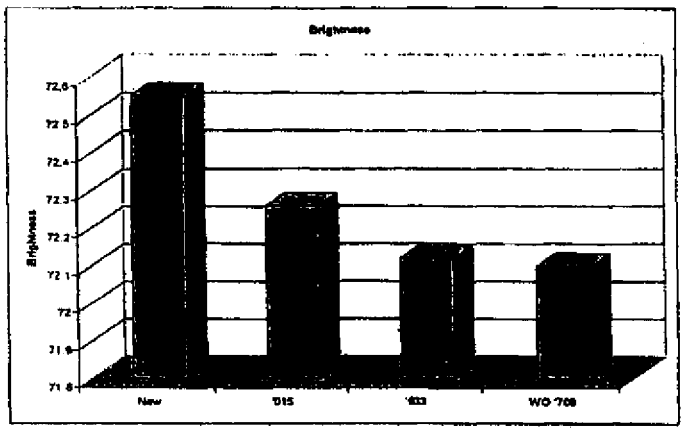
Figure 8:
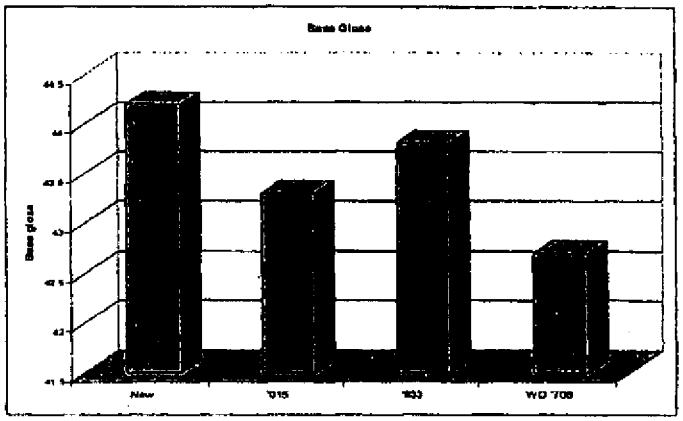

FIG. 2 is a diagrammatic representation of a second type of coater 20 known as a "short dwell coater", which is being increasingly implemented by the paper coating industry. This type of coater is operated at very high speed (up to 5000 ft. per min.) with high coating solids loadings. These are very desirable operating conditions. In FIG. 2 the paper web 27 travels at very high speed on the backing roll 21. The coating mixture containing the phospholipid lubricant described in the invention is pumped to the reservoir 22. The coating mixture then passes through the coating head as diagrammed and enters chamber 23. This chamber creates an increased hydraulic pressure of the coating which flows against the paper web. This action applies the coating to the web. The coating is uniformly metered off the sheet with a blade 24.

This lubricant invention has been shown to improve both the wet and dry coating characteristics and runnability when run in this type of coater. Specifically, the problems of whiskering and streaking are either eliminated or greatly reduced.

Phospholipid Lubricant

As described above, the preferred phospholipid for the lubricant is lecithin. Lecithin is a term sometimes used specifically to describe phosphatidyl cholines, but in this application we use the term in its more general sense to include other phosphatidyl derivatives as well, such as phosphatidylinositol, phosphatidylethanolamines, and phosphatidic acid. Particularly, we use the term to include mixtures of phosphatidyl derivatives together with fatty acids. For example commercially supplied lecithin products contain constituent fatty acids such as linoleic, linolenic oleic, palmitic and stearic acids. Most lecithin products supplied in liquid form also contain an oil portion, usually derived from soy beans, and used as a vehicle or solvent for the phospholipid components. Modified lecithins such as hydroxylated lecithins can also be used.

Yelkin SS single-bleached, fluid consistency grade of soya-lecithin available from ADM Corporation, 4600 Faries Parkway, Decatur, Ill. 62526 is a suitable lecithin for use in the invention. Other grades and forms of lecithin may be used. Central Soya Co., Inc. of Fort Wayne, Ind. is also a supplier.

The lecithin is mixed with a vehicle such as oleic acid, palmitic acid, coconut fatty acid, stearic acid or fatty acid ester. The coating lubricant composition also includes a non-ionic emulsifier such as the alcohol ethoxylates listed below.

Because lubricant formulations based on a lecithin composition generally are not aqueous dispersible, the surfactant component is important in order to insure that the lubricant formulation is completely and uniformly dispersed throughout the coating mixture without adverse affect. We have surprisingly discovered that low HLB surfactants (e.g., surfactants having an HLB of between 7 and about 10) offer superior aqueous dispersion of the lubricant formulation in the coating mixture. The selection of a specific surfactant depends on the particular coating mixture formulation for which the lubricant formulation of the invention is intended, and on factors such as type of coating, conditions of use, and end use requirements of the coated paper must be considered.

Certain preferred lubricant additive mixtures adapted for combination with an aqueous-based paper or paper board coating mixture provided by the instant invention include those additive mixtures comprising, by weight, about 65-75% lecithin, about 5-20% of a fatty acid, about 5-20% of a fatty acid ester, and about 2-15% of a surfactant having an HLB value of less than about 10.

Preferred lubricant additive mixtures include those in which the additive mixture comprises between 67-73% lecithin by weight, or more preferably comprises between 68-72% lecithin by weight.

More preferably, the surfactant has an HLB value of between about 7.5 and about 9.5. Certain preferred surfactants include alcohol ethoxylates, particularly aliphatic alcohol ethoxylates having a primary or secondary alcohol residue having between 8 and 20 carbon atoms and an ethoxylate chain having between two and five ethylene oxide residues. Typically preferred alcohol ethoxylates of the invention have an HLB value of between about 7 and about 10 or more preferably between about 7.5 and about 9.5.

Certain preferred aliphatic alcohol ethoxylates which are suitable for use in the lubricant additive mixtures of the invention include alcohol ethoxylates of Formula I:

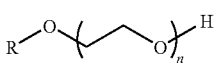

I wherein R is at least one $C_8$-$C_{20}$alkyl group which may be straight or branched and n represents an average value of the number of ethoxylate residues which is selected from real numbers of between about 2 and about 5.

Certain preferred alcohol ethoxylates of Formula I include those in which R represents between 1-5 linear or branched $C_8$-$C_{20}$alkyl groups having the same or different number of carbon atoms and the same or different branching position and are referred to herein as compounds of Formula I-a.

Certain preferred alcohol ethoxylates of Formula I include those in which R represents between 1-4 linear $C_8$-$C_{20}$alkyl groups which are referred to herein as compounds of Formula I-b.

Certain preferred alcohol ethoxylates of Formula I include those in which R represents between 1-4 linear alkyl groups selected from nonyl, decyl undecyl, dodecyl, tetradecyl, hexadecyl, and octadecyl which are referred to herein as compounds of Formula I-c.

Certain preferred alcohol ethoxylates of Formula I include those in which R represents nonyl, decyl, undecyl, dodecyl, a mixture of nonyl and undecyl groups, a mixture of dodecyl and tetradecyl groups, a mixture of dodecyl, tetradecyl and hexadecyl groups, or a mixture of $C_{12-15}$ alkyl groups which are referred to herein as compounds of Formula I-d.

Certain preferred alcohol ethoxylates according to any one of Formula I, I-a, I-b, I-c, and/or I-d include those alcohol ethoxylates in which n represents one or more integers. That is, preferred alcohol ethoxylates according to any one of Formula I, I-a, I-b, I-c, and/or I-d include those in which a variable number of ethylene oxide residues are condensed onto the alcohol hydroxyl residue (e.g., R—OH). In certain preferred alcohol ethoxylates according to any one of Formula I, I-a, I-b, I-c, and/or I-d, the average value of n is a real number of between about 2.5 and about 4, or more preferably n is a real number of between about 3 and about 4.

Certain preferred alcohol ethoxylates according to any one of Formula I, I-a, I-b, I-c, and/or I-d include those alcohol ethoxylates having an HLB value of between about 7.5 and about 9.5.

We have discovered that surfactants can be used in the formulation of the phospholipid lubricant in order to improve the lubricity, rheology, and handling characteristics of the coating to which the invention has been added. Various low HLB alcohol ethoxylates have been shown to act as effective surfactants. Certain preferred low HLB alcohol ethoxylate surfactants include those listed in Table 1

TABLE 1

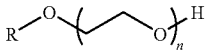

| Trade name | R | n (average value) |
|---|---|---|
| Tomadol 91-2.5 | mixture of $C_{9-11}$ alkyl | 2.5 |
| Tomadol 25-3 | mixture of $C_{12-15}$ alkyl | 3 |
| Tomadol 1-3 | $C_{11}$ alkyl | 3 |
| Genapol UD-030 | $C_{11}$ alkyl | 3 |
| Genapol 26-L-3 | mixture of $C_{12-16}$ alkyl | 3 |
| Surfonic L10-3 | $C_{10}$ alkyl | 3 |
| Surfonic L12-3 | $C_{12}$ alkyl | 3 |
| Surfonic L24-3 | mixture of $C_{12}$ and $C_{14}$ alkyl | 3 |
| Surfonic L42-3 | mixture of $C_{12}$ and $C_{14}$ alkyl ($C_{14}$ alkyl predominates) | 3 |
| Surfonic L24-4 | mixture of $C_{12}$ and $C_{14}$ alkyl | 4 |

Tomadol alcohol ethoxylates are produced by Tomah Products, Inc. of Milton, Wis., Genapol alcohol ethoxylates are produced by Clariant Corporation of Charlotte, N.C., and Surfonic alcohol ethoxylates are produced by Huntsman Corporation of Houston, Tex.

The alkyl chain of the alcohol can be a single chain length or mixed multiple chain length containing from 8 to 20 carbon atoms or more preferably between 9 to 16 carbons and containing between about 2-5 moles of ethylene oxide, or more preferably between about 2.5-4 moles of ethylene oxide. The alcohol may be primary or secondary, and the alkyl chain may be linear or branched. Preferred alcohol ethoxylates suitable for the lubricant formulations of the invention are water dispersible and have an HLB value of ~7.5 to ~9.5. Certain preferred examples of commercially available alcohol ethoxylates that are suitable for use in the lubricant formulations of the invention include Tomadol 91-2.5, Tomadol 25-3 and Tomadol 1-3 from Tomah Chemical; Genapol UD-030 and Genapol 26-L-3 from Clariant and Surfonic L10-3, Surfonic L12-3, Surfonic L24-3, Surfonic L42-3 and Surfonic L24-4 from Huntsman Corporation. There are many other manufacturers of alcohol ethoxylates but Tomah, Clariant and Huntsman are our prime suppliers.

Because of the generation of very high shear forces and hydraulic pressures encountered at the point of application of the coating mixture, it is important to control the rheological properties of the coating. These coating flow properties include viscosity, shear stability, foaming and homogeneity. As machine speed is increased, the performance demands of the coating lubricant are even more critical.

It has been discovered that the application of this novel phospholipid-containing material as specified in this invention greatly improves the uniformity and quality of the coating in both the wet and dry states. Its use greatly reduces streaking, formation of whiskers, and fish eyes. These terms are familiar to those experienced in the coating art.

The following examples illustrate suitable lubricant compositions.

EXAMPLE 1

A Generic offset coating having a formulation of Table 2 was prepared and then maintained in at between 95-100° F. (35-37.8° C.).

| Component | Parts |
|---|---|
| Delam. Clay | 64 |
| #2 Clay | 24 |
| Calcined Clay | 6 |
| TiO2 | 6 |
| Plastic pigment (1055) | 3.5 |
| S/B latex | 11 |
| PG 270 | 6 |
| Berset 2155 | 0.13 |
| pH | 8.3-8.6 w/caustic |
| % Solids | 57.0-57.5% |
| Target visc. | 2000 cps @ 100 rpm |
| Temp. | 95-100° F. |
| Coat weight | 4.5 lbs/side |

PG 270 is an ethylated corn starch.

EXAMPLE 2

The coating mixture of example 1 was mixed with a lubricant additive mixture at 100:1 by dry weight. The lubricant additive mixture contains the ingredients in the relative proportions indicated in Table 3. The lubricant additive mixture of Example 2 is referred to as "New" in the drawings and tables of data which follow.

TABLE 3

| | |
|---|---|
| Lecithin | 69.0% |
| Oleic acid | 10.0% |
| Fatty acid ester | 12.0% |
| Alcohol ethoxylate | 9.0% |

COMPARATIVE EXAMPLE 1

The coating mixture of example 1 was mixed with the lubricant additive mixture of Example 2 of U.S. Pat. No. 4,766,015 at 100:1 by dry weight. The lubricant additive mixture contains the ingredients in the relative proportions indicated in Table 4. The lubricant additive mixture of Comparative Example 1 is referred to as "'015" in the drawings and tables of data which follow.

TABLE 4

| | |
|---|---|
| Lecithin | 52.5% |
| Oleic acid | 35.0% |
| Trydet 2692A | 12.5% |

COMPARATIVE EXAMPLE 2

The coating mixture of example 1 was mixed with the lubricant additive mixture of Example 1 of U.S. Pat. No. 5,858,933 at 100:1 by dry weight. The lubricant additive mixture contains the ingredients in the relative proportions indicated in Table 5. The lubricant additive mixture of Comparative Example 2 is referred to as "'933" in the drawings and tables of data which follow.

TABLE 5

| | |
|---|---|
| Hydroxylated Lecithin | 47.0% |
| Fatty acid ester | 47.0% |
| Surfonic N-95 | 6.0% |

COMPARATIVE EXAMPLE 3

The coating mixture of example 1 was mixed with the lubricant additive mixture of Example 2 of International Patent Publication WO 01/51706 at 100:1 by dry weight. The lubricant additive mixture contains the ingredients in the relative proportions indicated in Table 6. The lubricant additive mixture of Comparative Example 2 is referred to as "WO '706" in the drawings and tables of data which follow.

TABLE 6

| | |
|---|---|
| Lecithin | 83.0% |
| Fatty acid ester | 15.0% |
| Tergitol NP-9 | 2.0% |

EXAMPLE 3

Analytical Methods for the Lubricant Formulations

The coating mixtures recited in Example 2 and Comparative Examples 1-3 were tested using standard analytical procedures for (1) pH, (2) Brookfield viscosity (at 100 rpm), (3) Hercules high shear viscosity ("E" bob, 4400 rpm), and (4) Gravimetric water retention (60 sec. test). Data is presented in Table 7.

EXAMPLE 4

Paper Produced Using the Lubricant Additive Mixtures of Example 2 and Comparative Examples 1-3

A light weight coated (LWC) basestock was coated with the coating mixture/lubricant additive mixture recited in Example 2 and Comparative Examples 1-3 to a coat weight of 4.5 lbs/ream/side. The sheets were then dried in a single pass for 2 minutes on a drum dryer at 250° F. (121° C.) and then conditioned overnight.

The coated and dried sheets were then subjected to Supercalendering for 2 nips at 1000 psi and 150° F. to achieve the gloss target of 43.

EXAMPLE 5

Analytical Methods for the Paper Sheets Coated with the Coating Mixture/Lubricant Additive Mixture of Example 2 and Comparative Examples 1-3

The sheets coated with the coating mixture/lubricant additive mixture of Example 2 and Comparative Examples 1-3 were tested using standard procedures for base gloss, brightness, and IGT dry pick specified by TAPPI (Technical Association of the Pulp and Paper Industry). Data is presented in Table 7.

TABLE 7

| Lubricant | Dosage (parts) | pH | BFV (cps) | HHSV (cps) | GWR (g/m$^2$) | Base Gloss | IGT Dry Pick (cm/sec) | Bright |
|---|---|---|---|---|---|---|---|---|
| New | 1.0 | 8.02 | 1940 | 57.0 | 48.6 | 44.2 | 55 | 72.55 |
| '015 | 1.0 | 7.96 | 2180 | 60.3 | 49.3 | 43.3 | 53 | 72.26 |
| '933 | 1.0 | 8.01 | 2000 | 66.2 | 43.2 | 43.8 | 48 | 72.12 |
| WO '706 | 1.0 | 8.00 | 1920 | 61.6 | 50.2 | 42.7 | 53 | 72.10 |

Coatings are normally applied to paper at a pH of 8-8.5. BFV is Brookfield viscosity and is a measure of low shear viscosity (2000 cPs is a normal viscosity for coating paper). HHSV is the Hercules High Shear Viscosity and is an indication of what someone would expect to experience in normal mill production (A lower number correlates to a lower blade pressure which also correlates to higher machine speeds and more production). GWR is Gravimetric Water Retention (A lower number indicates better water retention). IGT Dry Pick is a measure of the strength of the coating (A higher number indicates a stronger coating).

Other embodiments are within the following claims. For example, the lubricant additive mixture may be applied to the paper separately from the coating; e.g., the lubricant may be sprayed onto the moving web to alleviate sticking, picking or dusting.

What is claimed is:

1. A lubricant additive mixture adapted for combination with an aqueous-based paper or paper board coating mixture, said additive mixture comprising, by weight, about 65-75% lecithin, about 5-20% of a fatty acid, about 5-20% of a fatty acid ester, and about 2-15% of a surfactant having an HLB value of less than about 10.

2. The lubricant additive mixture of claim 1, wherein the surfactant has an HLB value of between about 7.5 and about 9.5.

3. The lubricant additive mixture of claim 1, wherein the additive mixture comprises 67-73% lecithin by weight.

4. The lubricant additive mixture of claim 1, wherein the additive mixture comprises 68-72% lecithin by weight.

5. The lubricant additive mixture of claim 1, wherein the surfactant is an alcohol ethoxylate.

6. The lubricant additive mixture of claim 1, wherein the surfactant comprises at least one alcohol ethoxylate having an HLB value of between about 7 and about 10.

7. The lubricant additive mixture of claim 6, wherein the surfactant is an alcohol ethoxylate having a primary or secondary alcohol residue having between 8 and 20 carbon atoms and an ethoxylate chain having between two and five ethylene glycol residues.

8. The lubricant additive mixture of claim 1, wherein the surfactant has an HLB value of between about 7.5 and about 9.5.

9. The lubricant additive mixture of claim 1, wherein the surfactant is an alcohol ethoxylate of the formula:

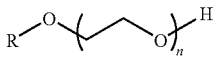

wherein R is at least one $C_8$-$C_{20}$ alkyl group which may be straight or branched and n represents an average value of the number of ethoxylate residues which is selected from real numbers of between about 2 and about 5.

10. The lubricant additive mixture of claim 9, wherein R represents between 1-5 linear or branched $C_8$-$C_{20}$ alkyl groups having the same or different number of carbon atoms and the same or different branching position.

11. The lubricant additive mixture of claim 10, wherein n is a real number of between about 2.5 and about 4.

12. The lubricant additive mixture of claim 10, wherein the surfactant has an HLB value of between about 7.5 and about 9.5.

13. The lubricant additive mixture of claim 9, wherein R represents between 1-4 linear $C_8$-$C_{20}$ alkyl groups.

14. The lubricant additive mixture of claim 13, wherein n is a real number of between about 2.5 and about 4.

15. The lubricant additive mixture of claim 13, wherein the surfactant has an HLB value of between about 7.5 and about 9.5.

16. The lubricant additive mixture of claim 13, wherein R represents between 1-4 linear alkyl groups selected from nonyl, decyl undecyl, dodecyl, tetradecyl, hexadecyl, and octadecyl.

17. The lubricant additive mixture of claim 16, wherein n is a real number of between about 2.5 and about 4.

18. The lubricant additive mixture of claim 16, wherein the surfactant has an HLB value of between about 7.5 and about 9.5.

19. The lubricant additive mixture of claim 13, wherein R represents nonyl, decyl, undecyl, dodecyl, a mixture of nonyl and undecyl groups, a mixture of dodecyl and tetradecyl groups, a mixture of dodecyl, tetradecyl and hexadecyl groups, or a mixture of $C_{12-15}$ alkyl groups.

20. The lubricant additive mixture of claim 19, wherein n is a real number of between about 2.5 and about 4.

21. The lubricant additive mixture of claim 19, wherein the surfactant has an HLB value of between about 7.5 and about 9.5.

22. An aqueous-based paper or paper board coating mixture comprising clay and a lubricant additive mixture comprising, by weight, about 65-75% lecithin, about 5-20% of a fatty acid, about 5-20% of a fatty acid ester, and about 2-15% of a surfactant having an HLB value of less than about 10.

23. The coating mixture of claim 22 comprising a solid content by weight of between 50 and 75%.

24. The coating mixture of claim 22, having the following composition by weight: 10-90% binder, 10-90% pigment and 0.2-5% of the lubricant additive mixture.

25. The coating mixture of claim 24 wherein the lubricant additive mixture comprises a fatty acid selected from the group consisting of linoleic acid, oleic acid, palmitic acid, acid stearic, and coconut fatty acid.

26. The lubricant additive mixture of claim 1, wherein at least the lecithin and the surfactant are in the same phase.

27. The lubricant additive mixture of claim 1, wherein the lecithin, the fatty acid, the fatty acid ester and the surfactant are in the same phase.

* * * * *

UNITED STATES PATENT AND TRADEMARK OFFICE

CERTIFICATE OF CORRECTION

PATENT NO. : 7,732,388 B2
APPLICATION NO. : 11/329710
DATED : June 8, 2010
INVENTOR(S) : Ray Peltier It is certified that error appears in the above-identified patent and that said Letters Patent is hereby corrected as shown below:

The sheets of drawings consisting of figures 1-8 should be deleted to appear as per attached figures 1-8.

Signed and Sealed this
Twenty-second Day of May, 2012

David J. Kappos

David J. Kappos
*Director of the United States Patent and Trademark Office*